US008777462B2

(12) United States Patent
Wu et al.

(10) Patent No.: US 8,777,462 B2
(45) Date of Patent: Jul. 15, 2014

(54) LAMP STRUCTURE WITH A HEAT DISSIPATION SPACE

(71) Applicant: Taiwan Fu Hsing Industrial Co., Ltd., Kaohsiung (TW)

(72) Inventors: Shun-Ho Wu, Kaohsiung (TW); Chih-Cheng Huang, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 0 days.

(21) Appl. No.: 13/661,121

(22) Filed: Oct. 26, 2012

(65) Prior Publication Data

US 2013/0335982 A1 Dec. 19, 2013

(30) Foreign Application Priority Data

Jun. 19, 2012 (TW) ..... 101121963 A

(51) Int. Cl.
*F21V 29/00* (2006.01)

(52) U.S. Cl.
USPC ..... 362/373; 362/382; 362/378

(58) Field of Classification Search
USPC ..... 362/373, 378, 362, 382
See application file for complete search history.

(56) References Cited

U.S. PATENT DOCUMENTS

| | | | | |
|---|---|---|---|---|
| 8,115,369 | B2 * | 2/2012 | Kang et al. | 313/45 |
| 2010/0126697 | A1 * | 5/2010 | Huang | 165/80.3 |
| 2011/0181183 | A1 * | 7/2011 | Yoo | 315/35 |
| 2013/0077323 | A1 * | 3/2013 | Huang | 362/382 |
| 2013/0188367 | A1 * | 7/2013 | Wu et al. | 362/362 |

* cited by examiner

*Primary Examiner* — Tracie Y Green
(74) *Attorney, Agent, or Firm* — Jackson IPG PLLC

(57) ABSTRACT

A lamp structure includes a case, a fixing base, a heat dissipation tube, a lighting module and an insulating sleeve. The fixing base is disposed at the case and comprises a carrier, and the lighting module is disposed on the carrier. The heat dissipation tube is coupled to the fixing base, and a heat dissipation space is defined between the heat dissipation tube and the case. The insulating sleeve is coupled to the fixing base. The heat produced by the lighting module can be conducted to the heat dissipation tube and the heat dissipation space through the fixing base to increase heat dissipation efficiency of the lamp structure.

19 Claims, 11 Drawing Sheets

LAMP STRUCTURE WITH A HEAT DISSIPATION SPACE

FIELD OF THE INVENTION

The present invention is generally related to a lamp structure, which particularly relates to the lamp structure with a heat dissipation tube.

BACKGROUND OF THE INVENTION

With reference to FIG. 11, a convention lamp structure 10 includes a substrate 11, a light emitting device 12, a base 13 and a lamp cover 14. The light emitting device 12 is disposed on the substrate 11, and the substrate 11 is disposed on the base 13. The lamp structure 10 produces massive heat and is unable to dissipate heat when the lamp structure 10 is in use, which results in a lower lighting efficiency or destruction through rising temperature of the light emitting device 12.

SUMMARY

The primary object of the present invention is to provide a lamp structure with a heat dissipation tube to overcome a lower lighting efficiency or destruction of a conventional LED lamp caused by overheat while the LED lamp is in use.

A lamp structure in the present invention includes a case, a fixing base, a heat dissipation tube, a lighting module and an insulating sleeve, wherein the case comprises a shell and an accommodating chamber surrounded by the shell. The fixing base is disposed at the case and comprises a carrier. The heat dissipation tube is coupled to the fixing base and extends inside the accommodating chamber of the case, wherein a heat dissipation space is defined between the heat dissipation tube and the shell. The lighting module is disposed at the carrier. The insulating sleeve is coupled to the fixing base. A conductive wire electrically connected with the lighting module is disposed within the insulating sleeve. By means of the heat dissipation space defined between the heat dissipation tube and the shell in the present invention, the heat produced from illumination of the lighting module can be conducted to the heat dissipation tube through the fixing base, thereafter the heat inside the heat dissipation space can be dissipated rapidly via heat convection. Therefore, the lighting module possesses fine opto-electronic conversion efficiency.

DETAILED DESCRIPTION OF THE INVENTION

Figure 1:
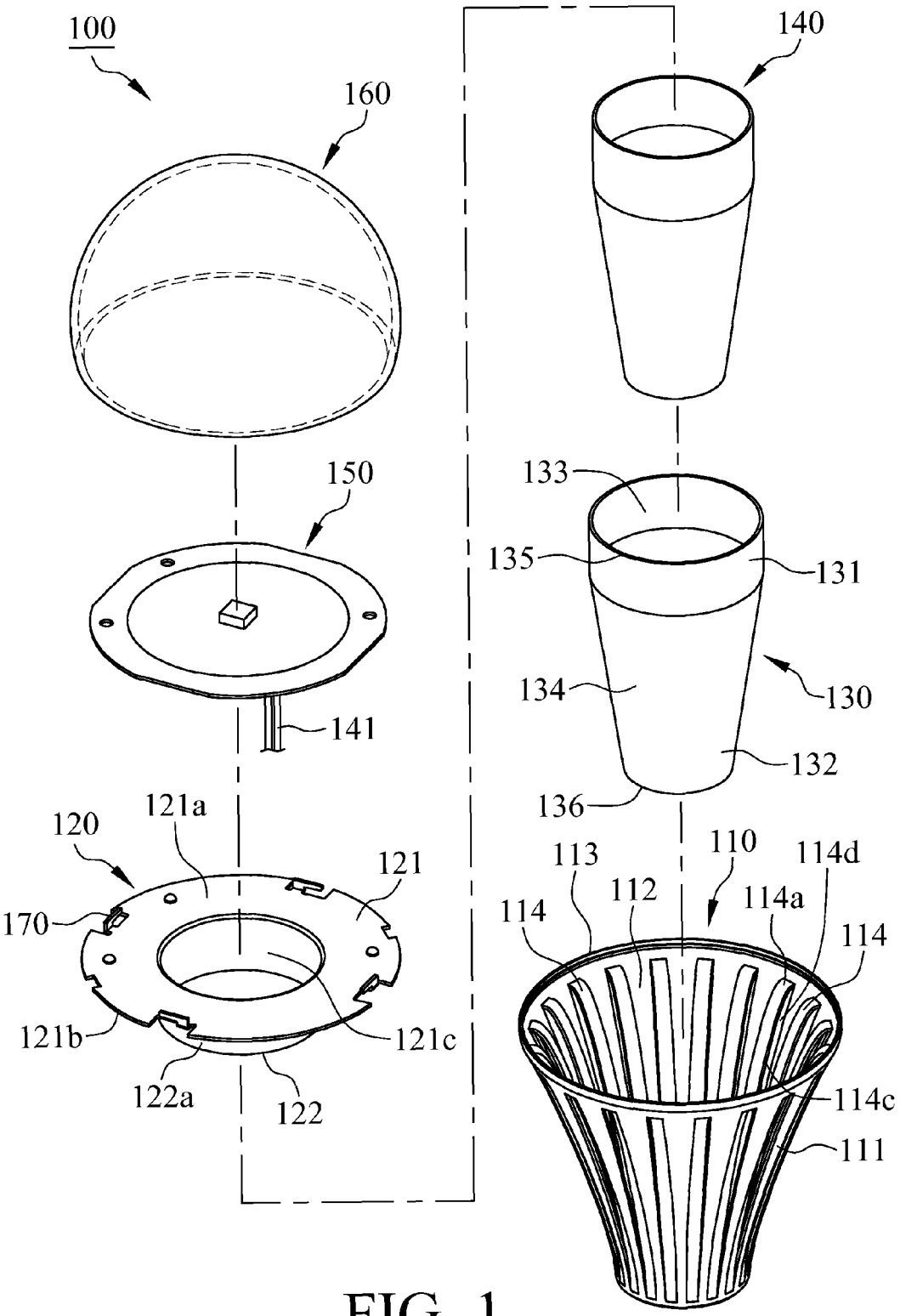
FIG. 1 is a perspective exploded diagram illustrating a lamp structure in accordance with a first embodiment of the present invention.
Figure 2:
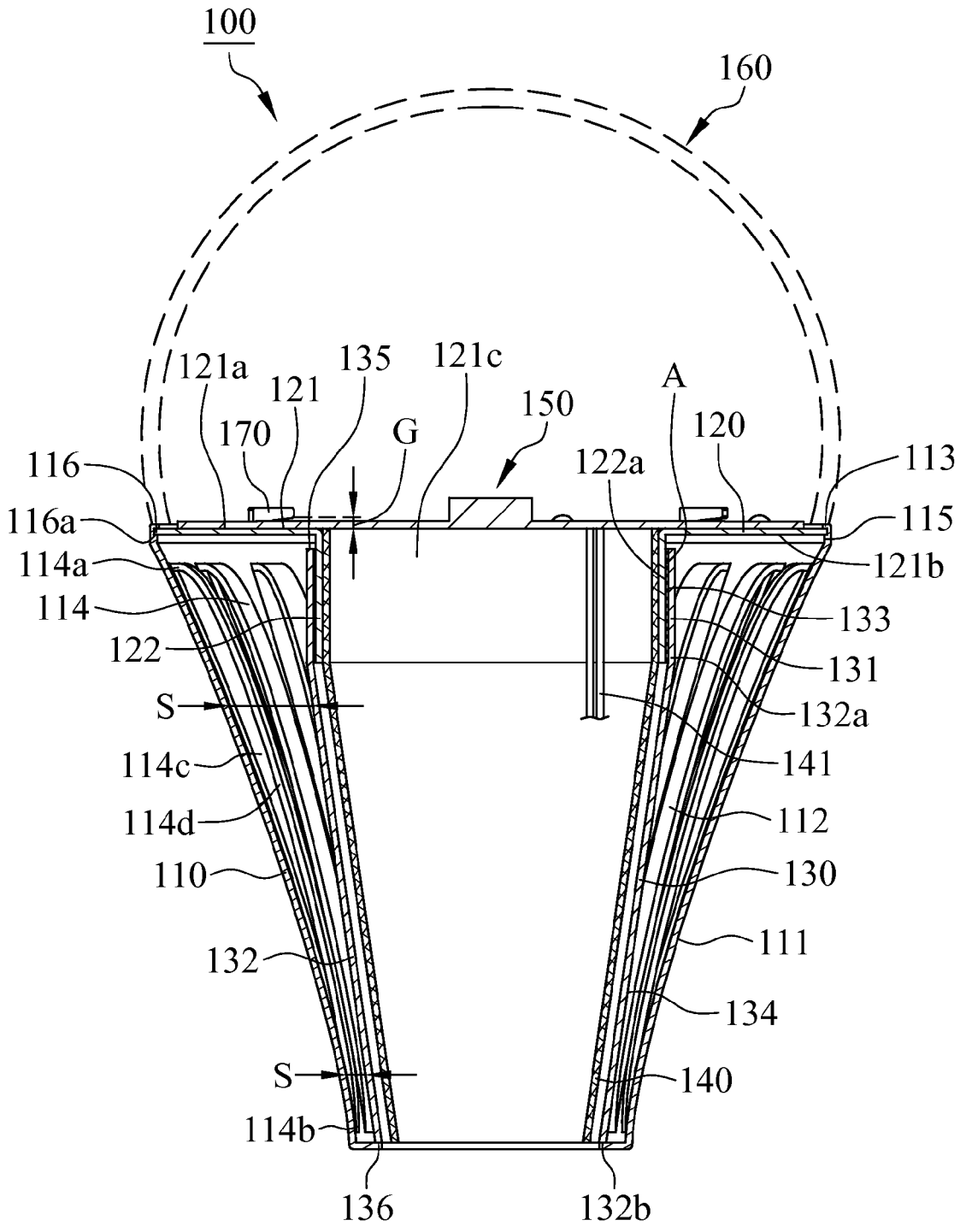
FIG. 2 is a section view illustrating a lamp structure in accordance with a first embodiment of the present invention.

With reference to FIGS. 1 and 2, a lamp structure 100 in accordance with a first embodiment of the present invention includes a case 110, a fixing base 120, a heat dissipation tube 130, an insulating sleeve 140 and a lighting module 150. The case 110 comprises a shell 111, an accommodating chamber 112 surrounded by the shell 111, a clamping portion 113 formed at the shell 111 and a plurality of fin plates 114, wherein the fin plates 114 are formed as one piece with the case 110 by means of stamping. The fin plates 114 protrude toward the accommodating chamber 112, wherein a top end 114*a* and a bottom end 114*b* of each fin plate 114 are in connection with the shell 111, and a lateral edge 114*c* of each fin plate 114 is not in connection with the shell 111 so as to form a gap 114*d*. The fixing base 120 is disposed at the case 110 and comprises a carrier 121 and an extending portion 122. The clamping portion 113 of the case 110 is bendable toward the accommodating chamber 112 and clamps the fixing base 120. The carrier 121 comprises an upper surface 121*a*, a lower surface 121*b* and an opening 121*c*, the extending portion 122 located at the accommodating chamber 112 extends from the opening 121*c* and protrudes to the lower surface 121*b*. The extending portion 122 comprises a first coupling surface 122*a*. Besides, the carrier 121 and the extending portion 122 are formed as one piece with the fixing base 120 by means of stamping. In this embodiment, the first coupling surface 122*a* is the external surface of the extending portion 122. The heat dissipation tube 130 is coupled to the extending portion 122 of the fixing base 120 and extends inside the accommodating chamber 112 of the case 110, wherein a heat dissipation space S is defined between the heat dissipation tube 130 and the shell 111. The heat dissipation tube 130 comprises a connection body 131, a heat dissipation body 132, a second coupling surface 133, an outer surface 134, a first end 135 and a second end 136. In this embodiment, the second coupling surface 133 is the internal surface of the connection body 131, the first end 135 is the upper edge of the heat dissipation tube 130, and the second end 136 is the lower edge of the heat dissipation tube 130 and contacts with the shell 111. The second coupling surface 133 of the heat dissipation tube 130 is connected with the first coupling surface 122*a* of the extending portion 122. The insulating sleeve 140 is coupled to the fixing base 120, and a conductive wire 141 electrically connected with the lighting module 150 is disposed within the insulating sleeve 140. Due to the contact between the first coupling surface 122*a* and the second coupling surface 133 and the heat dissipation space S defined between the heat dissipation tube 130 and the shell 111, the heat produced from illumination of the lighting module 150 can be conducted to the heat dissipation tube 130, and thereafter the heat inside the heat dissipation space S can be dissipated rapidly via heat convection.

Preferably, the lamp structure 100 further includes a conductive glue layer A between the second coupling surface 133 of the heat dissipation tube 130 and the first coupling surface 122*a* of the extending portion 122. The conductive glue layer A can be thermal conductive gel or thermal grease. The conductive glue layer A enables to completely seal up the first coupling surface 122*a* of the extending portion 122 and the second coupling surface 133 of the heat dissipation tube 130.

With reference to FIG. 2, the accommodating chamber 112 of the case 110 is formed in a tapered shape. Therefore, the outer diameter of the heat dissipation tube 130 gradually decreases from the first end 135 toward the second end 136 for making the heat dissipation tube 130 accommodated within the accommodating chamber 112 of the case 110. In this embodiment, preferably, the heat dissipation tube 130 comprises an top end portion 132*a* connected with the connection body 131 and a bottom end portion 132*b*, wherein the outer diameter of the heat dissipation body 132 gradually decreases from the top end portion 132*a* toward the lower end portion 132*b*. Due to constant outer diameter of the connection body 131, a larger contact area between the second coupling surface 133 of the heat dissipation tube 130 and the first coupling surface 122*a* of the extending portion 122 can be maintained. The lighting module 150 is disposed on the upper surface 121*a* of the carrier 121. The lighting module 150 is a single light emitting diode (LED), or, the lighting module 150 is a plurality of light emitting diodes. In the present invention, the heat generated from illumination of the lighting module 150 can be dissipated through the paths of the fin plates 114 of the case 110 and the heat dissipation tube 130 by means of thermal coupling between the case 110, the fixing base 120 and the heat dissipation tube 130. Therefore, the lighting module 150 possesses fine opto-electronic conversion efficiency.

In addition, the heat can be dissipated rapidly to external environment through the gaps 114*d* for the following reasons that the fin plates 114 protrude toward the accommodating chamber 112, the top end 114*a* and the bottom end 114*b* of each fin plate 114 connect with the shell 11, and the lateral edge 114*c* of each fin plate 114 does not connect with the shell 111 to form the gap 114*d*. Otherwise, this invention also utilizes the fin plates 114 of the case 110 to expand overall heat dissipating area of the case 110 to make the lighting module 150 possess fine opto-electronic conversion efficiency.

Besides, the outer diameter of the heat dissipation tube 130 gradually decreases from the first end 135 toward the second end 136, and the outline of the heat dissipation tube 130 is correspondingly matched to the cone-shaped design of the case 110. The cross section area of the heat dissipation space S defined between the heat dissipation tube 130 and the shell 111 gradually decreases from the first end 135 toward the second end 136, therefore, the second end 136 of the heat dissipation tube 130 enables to contact with the shell 111. Through the contact between the second end 136 of the heat dissipation tube 130 and the shell 111, the heat can be conducted to the bottom of the shell 111 to increase overall heat dissipating effect.

With reference to FIG. 2 again, in this embodiment, the lamp structure 100 further includes a lamp cover 160 and at least one fixing plate 170, wherein the lamp cover 160 is disposed at the case 110 and covers the fixing base 120 and the lighting module 150. A clamping space G is defined between the fixing plate 170 and the upper surface 121*a* of the carrier 121, and the lighting module 150 is clamped by the carrier 121 and the fixing plate 170. The lighting module 150 can be constrained in the clamping space G. Preferably, the case 110 further comprises an inner surface 115 and a slot 116 recessed to the inner surface 115, wherein the fixing base 120 is disposed at the slot 116. The slot 116 comprises a supporting surface 116*a*, and the fixing base 120 is clamped between the supporting surface 116*a* of the slot 116 and the clamping portion 113. The fixing plate 170 and the clamping portion 113 are bendable to clamp and secure the lighting module 150 and the fixing base 120 separately, which effectively raises assembling efficiency of the lamp structure 100.

Figure 3:
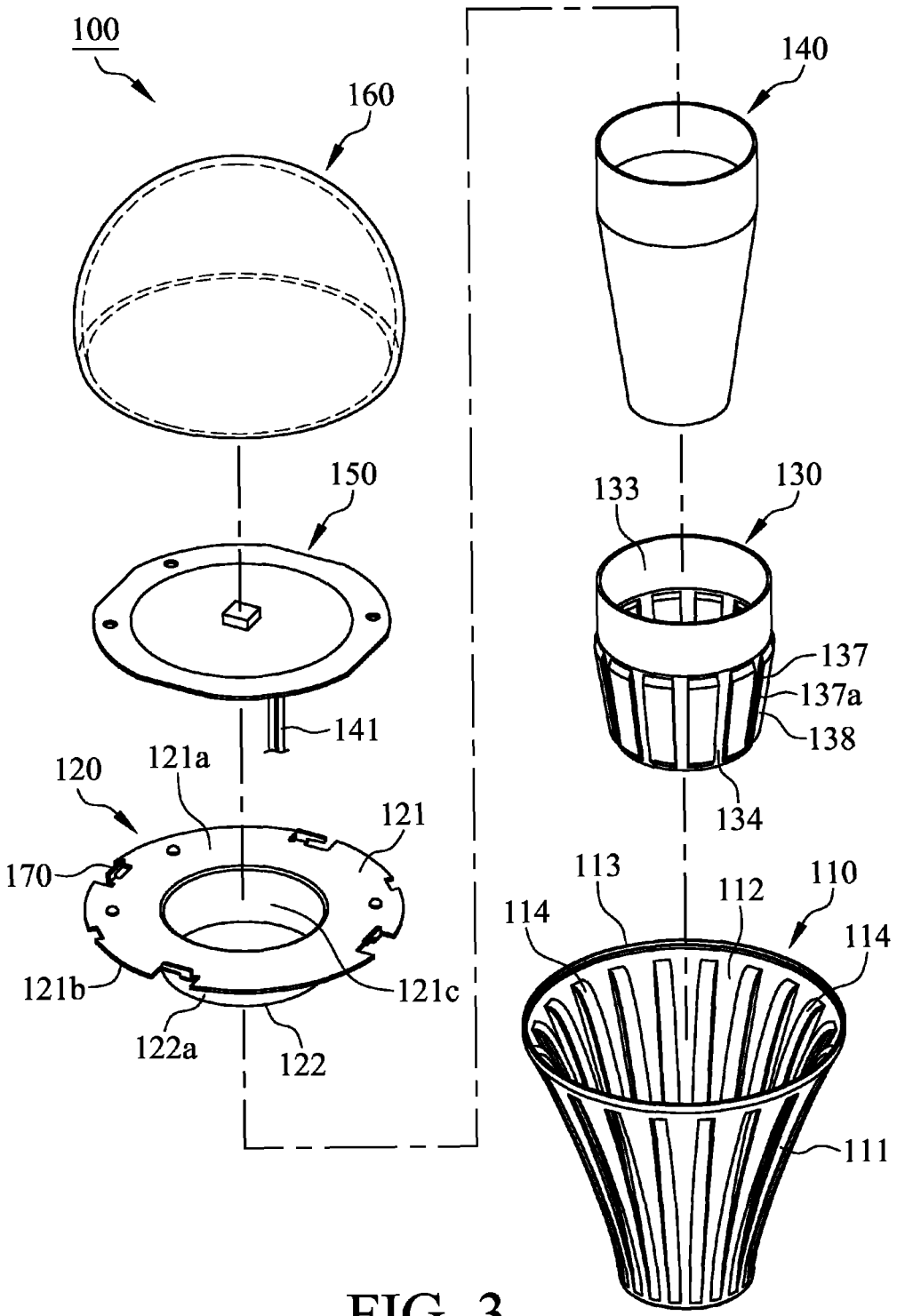
FIG. 3 is a perspective exploded diagram illustrating a lamp structure in accordance with a second embodiment of the present invention.
Figure 4:
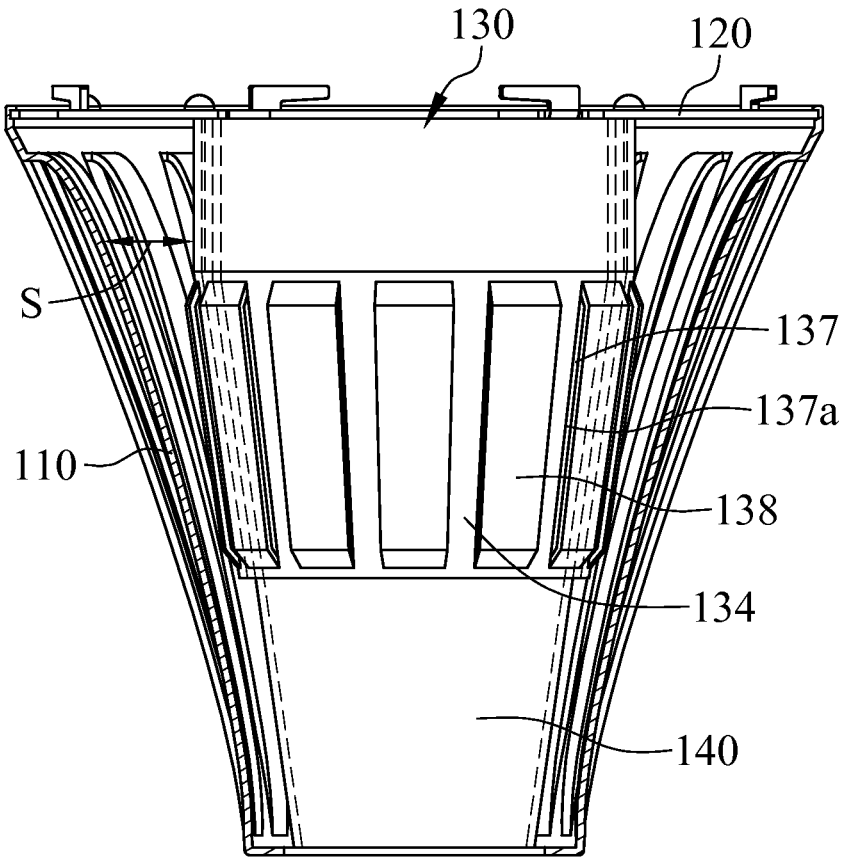
FIG. 4 is a section view illustrating a case, a fixing base, a heat dissipation tube and an insulating sleeve in accordance with a second embodiment of the present invention.

A second embodiment of the present invention is illustrated in FIGS. 3 and 4, the primary difference between the second embodiment and the first embodiment is that the heat dissipation tube 130 further comprises a plurality of penetration holes 137 and a plurality of projecting ribs 138, wherein each penetration hole 137 comprises a hole surface 137*a* and communicates with the second coupling surface 133 and the outer surface 134, and each projecting rib 138 connects the hole surface 137*a* of each penetration hole 137 and protrudes to the outer surface 134. The projecting ribs 138 enable to increase the heat dissipation area of the heat dissipation tube 130, and the heat can be conducted through ventilation of the penetration holes 137 to increase the heat dissipation efficiency of the heat dissipation tube 130.

Figure 5:
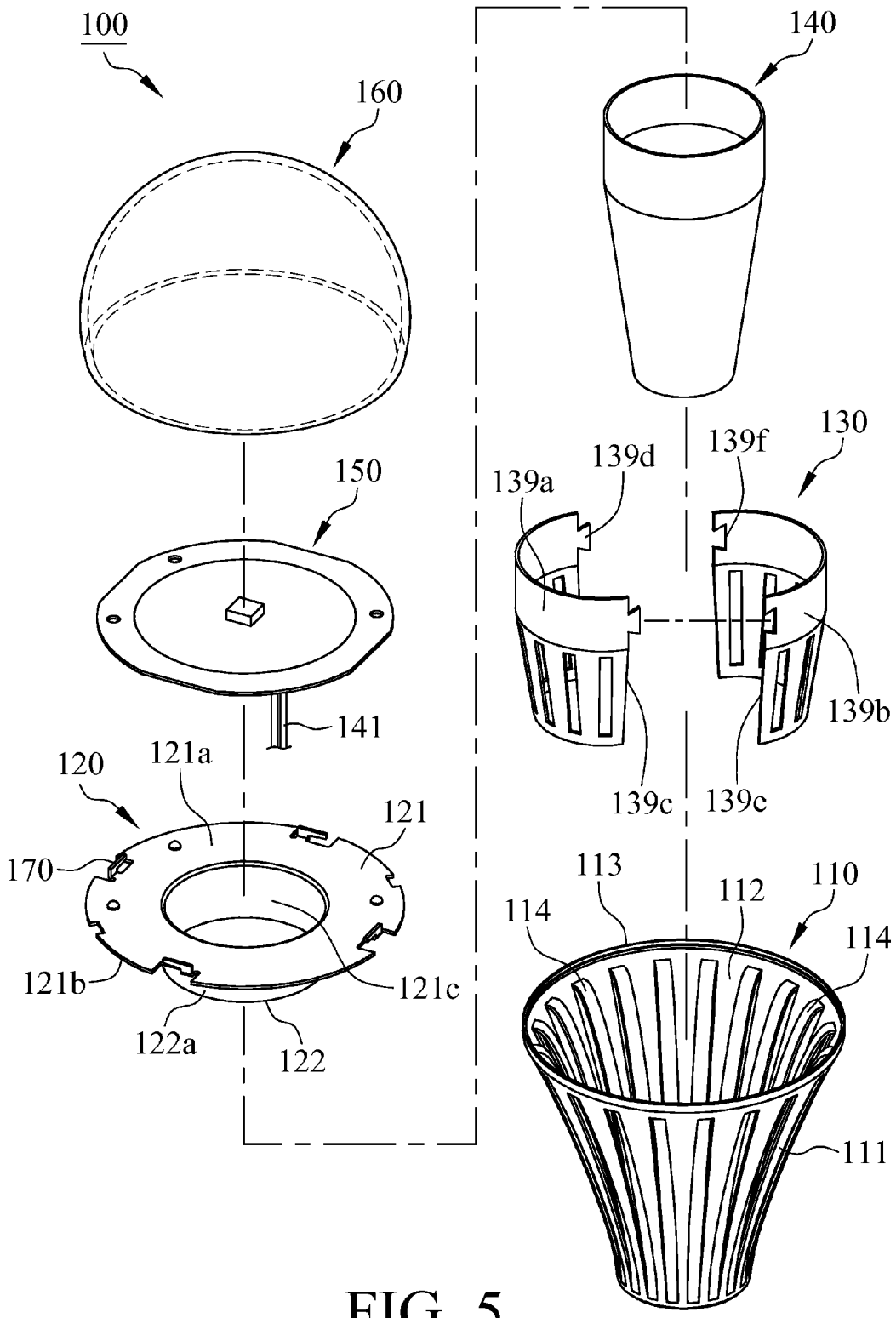
FIG. 5 is a perspective exploded diagram illustrating a lamp structure in accordance with a third embodiment of the present invention.
Figure 6:
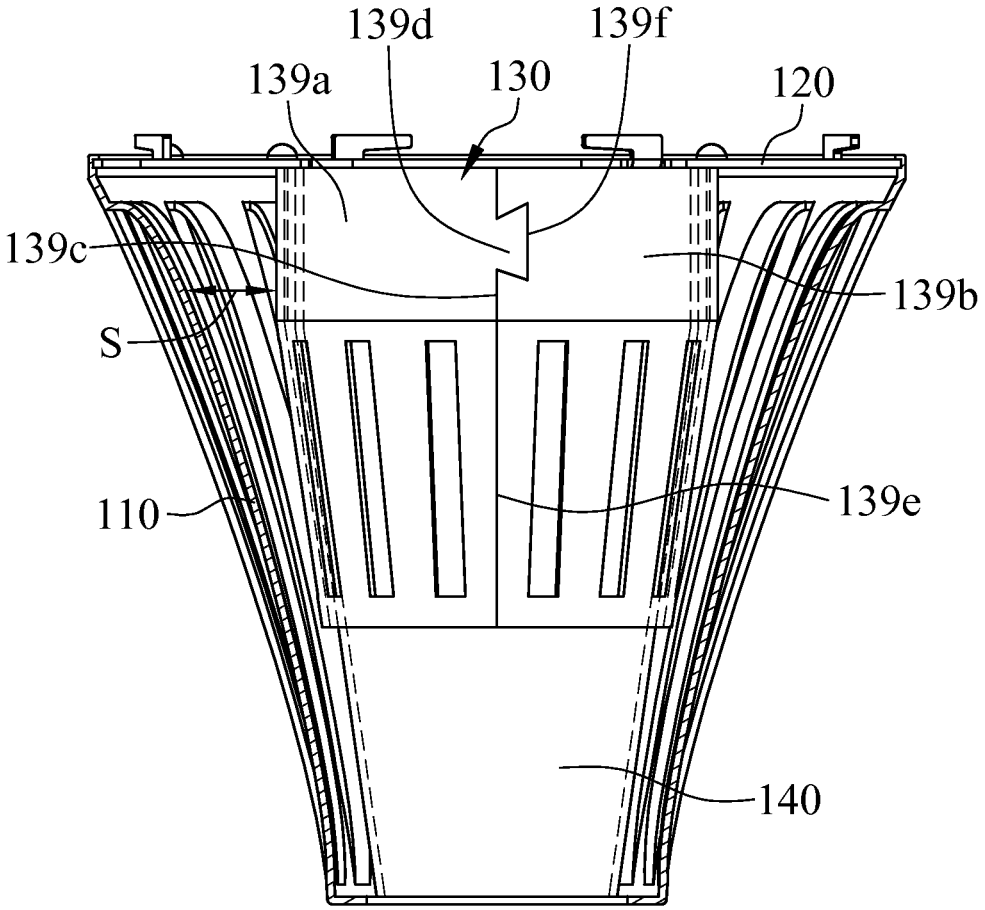
FIG. 6 is a section view illustrating a case, a fixing base, a heat dissipation tube and an insulating sleeve in accordance with a third embodiment of the present invention.

A third embodiment of the present invention is illustrated in FIGS. 5 and 6, the primary difference between the third embodiment and the first embodiment is that the heat dissipation tube 130 comprises a first conducting portion 139*a* and a second conducting portion 139*b*, the first heat conducting portion 139*a* comprises two first edges 139*c*, the second heat conducting portion 139*b* comprises two second edges 139*e*, a first connection member 139*d* is formed on each first edge 139*c*, a second connection member 139*f* is formed on each second edge 139*e*, and each first connection member 139*d* is coupled to each second connection member 139*f*. Through coupling between the first conducting portion 139*a* and the second conducting portion 139*b*, the heat dissipation tube 130 enables to be attached to the extending portion 122 of the fixing base 120.

Figure 7:
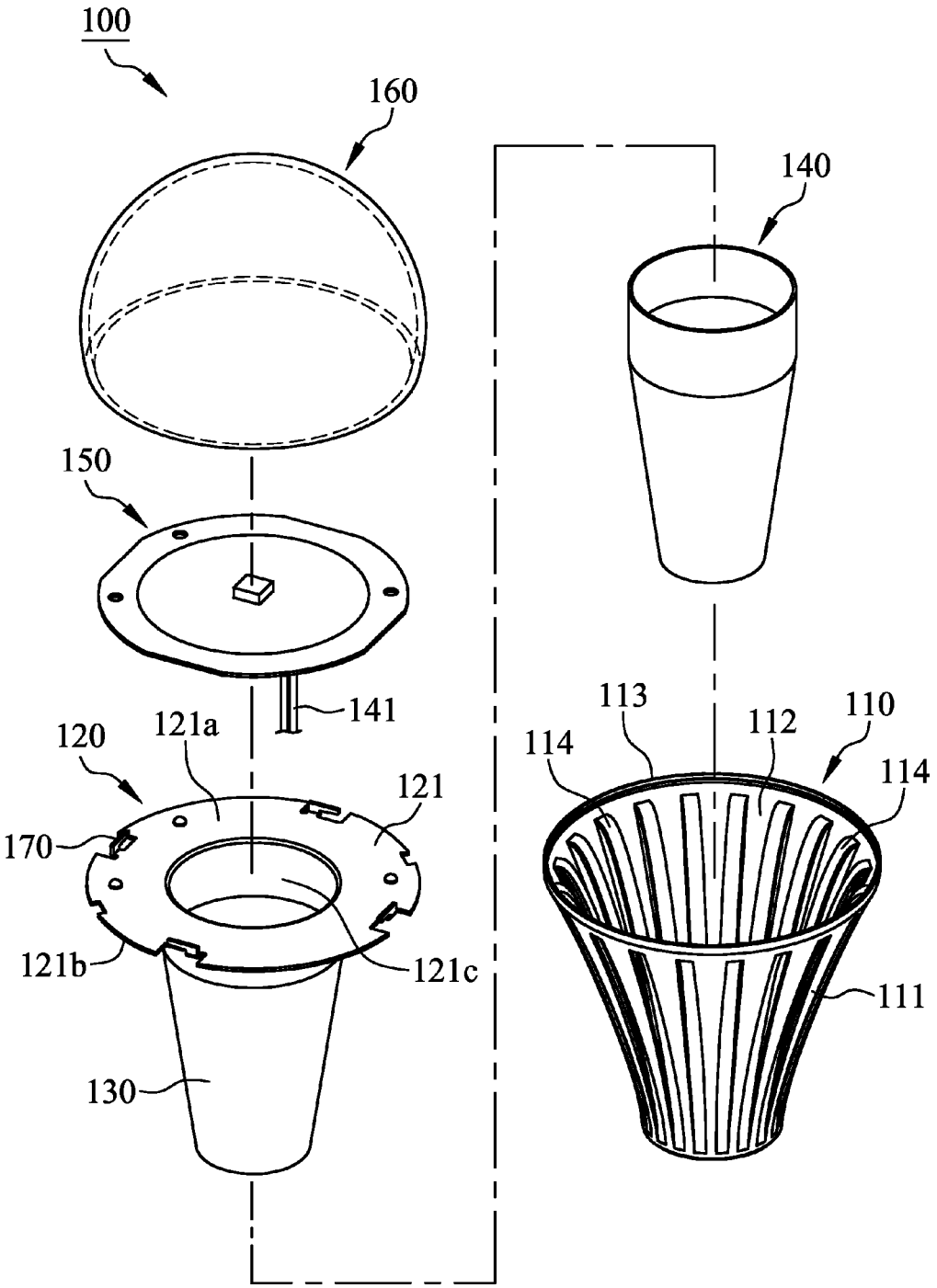
FIG. 7 perspective exploded diagram illustrating a lamp structure in accordance with a fourth embodiment of the present invention.
Figure 8:
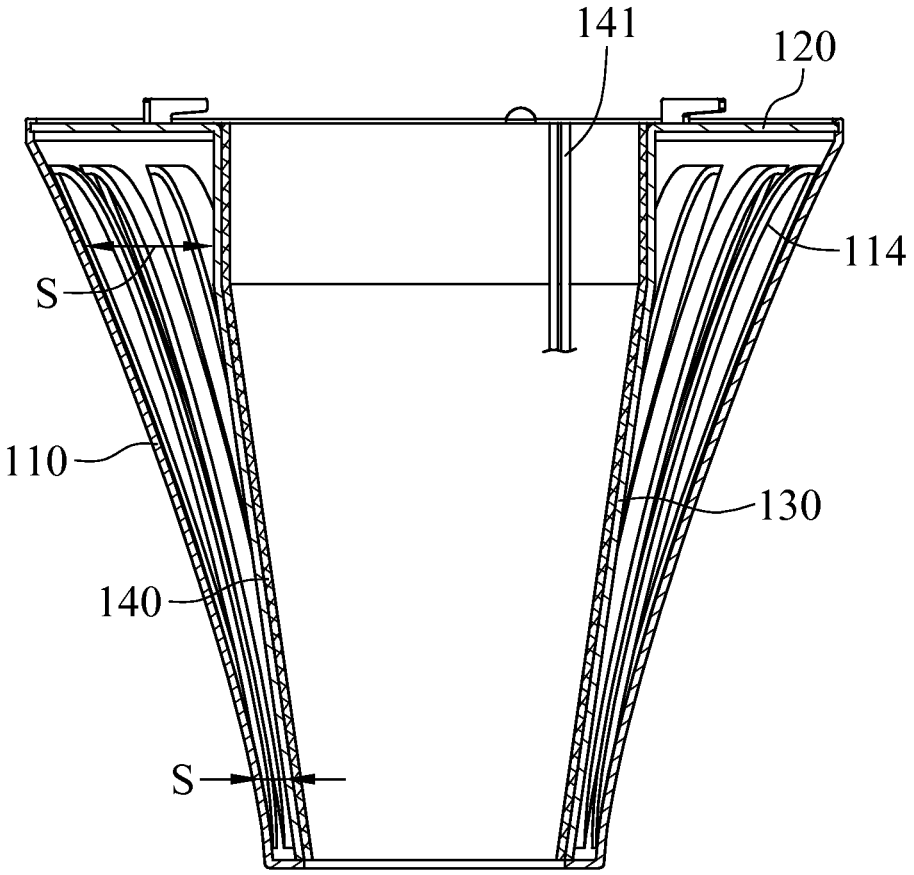
FIG. 8 is a section view illustrating a case, a fixing base, a heat dissipation tube and an insulating sleeve in accordance with a fourth embodiment of the present invention.

A fourth embodiment of the present invention is illustrated in FIGS. 7 and 8, the primary difference between the fourth embodiment and the first embodiment is that the heat dissipation tube 130 is formed as one piece with the fixing base 120 by means of stamping. The heat dissipation between the heat dissipation tube 130 and the fixing base 120 is better than first embodiment so as to increase the heat dissipation efficiency of the heat dissipation tube 130 owning to the reason that the heat dissipation tube 130 is formed as one piece with the fixing base 120.

Figure 9:
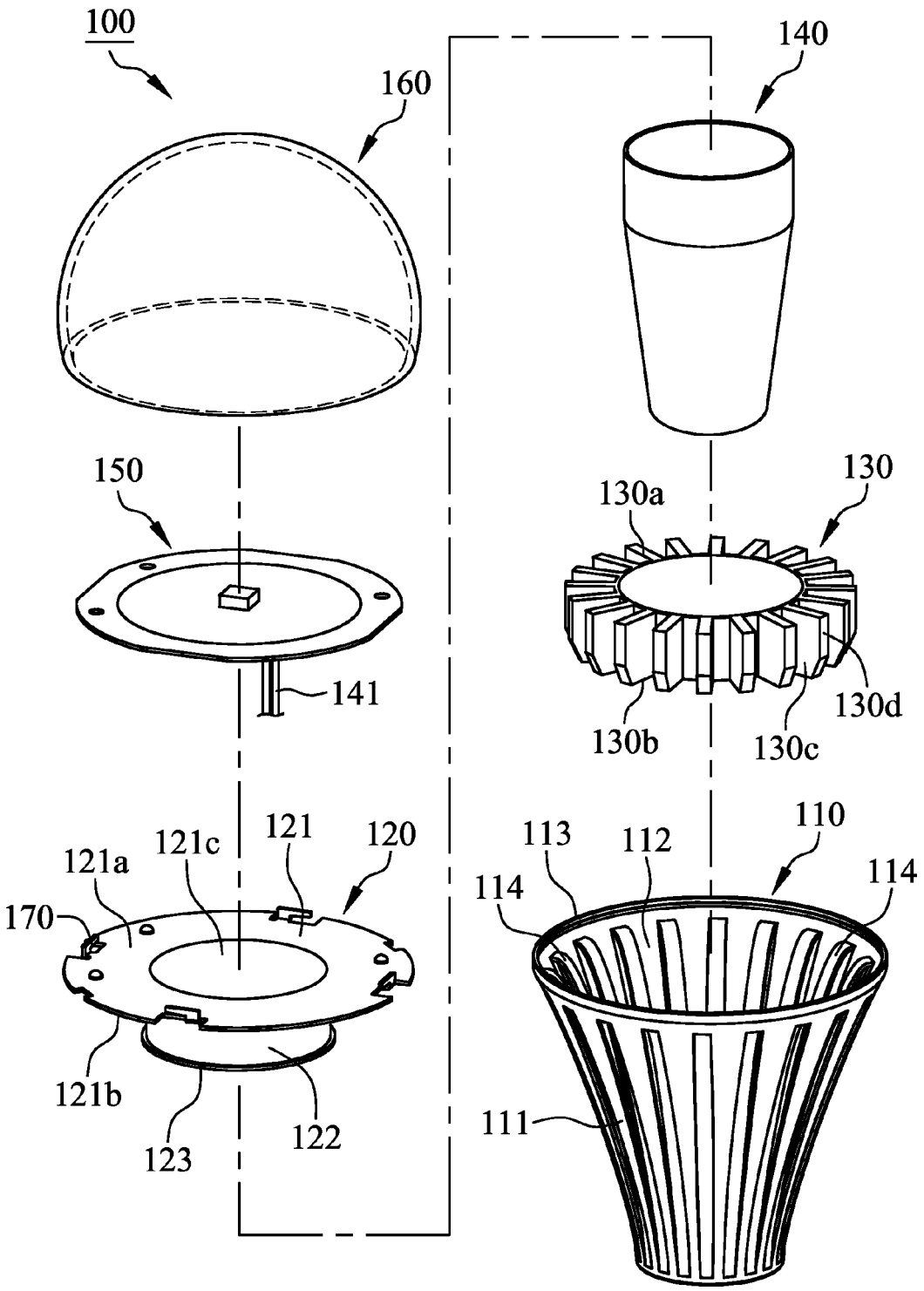
FIG. 9 is a perspective exploded diagram illustrating a lamp structure in accordance with a fifth embodiment of the present invention.
Figure 10:
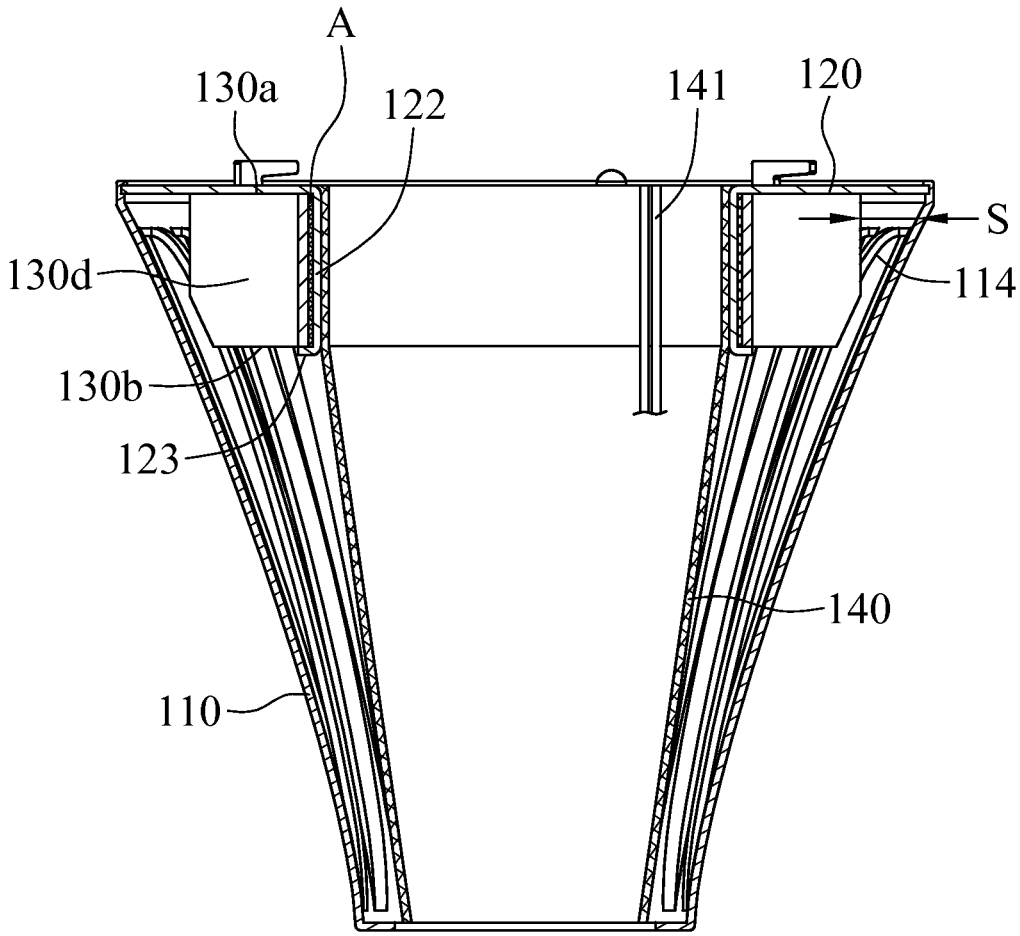
FIG. 10 is a section view illustrating a case, a fixing base, a heat dissipation tube and an insulating sleeve in accordance with a fifth embodiment of the present invention.
Figure 11:
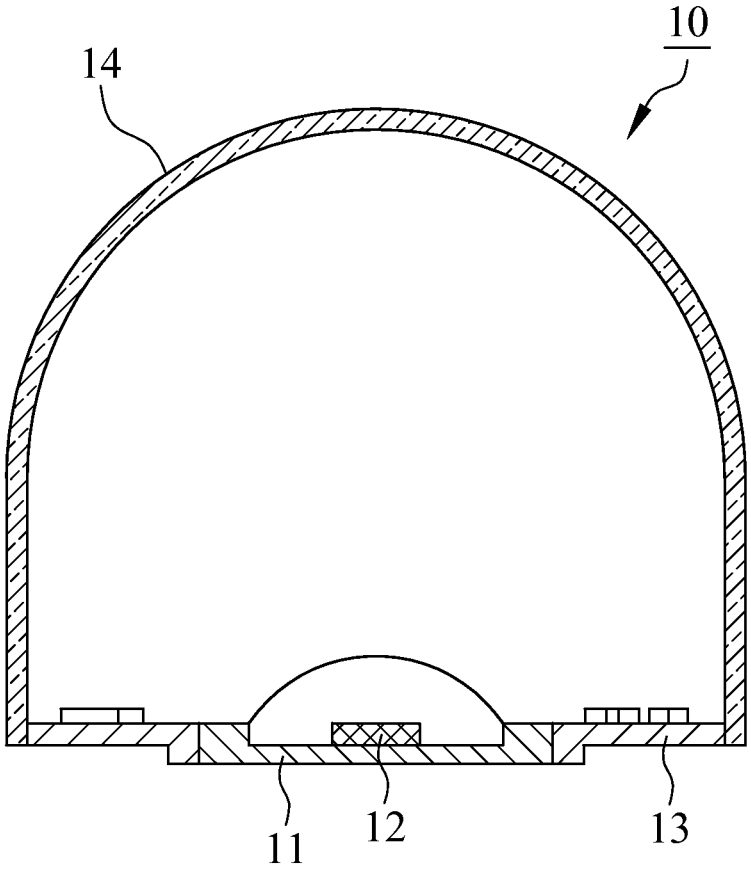
FIG. 11 PRIOR ART
FIG. 11 is a section view of a conventional lamp structure.

A fifth embodiment of the present invention is illustrated in FIGS. 9 and 10, the primary difference between the fifth embodiment and the first embodiment is that the heat dissipation tube 130 further comprises a first surface 130*a*, a second surface 130*b*, a plurality of slots 130*c* and a plurality of projecting ribs 130*d*. The fixing base 120 further comprises a constraining portion 123 disposed at the extending portion 122, and the heat dissipation tube 130 is constrained between the carrier 121 and the constraining portion 123. The slots 130*c* are in communication with the first surface 130*a* and the second surface 130*b*. Each projecting rib 130*d* and each slot 130*c* are arranged alternately, and each projecting rib 130*d* of the heat dissipation tube 130 is located between adjacent fin plates 114. In this embodiment, the projecting ribs 130*d* enable to increase the contact area between the heat dissipation tube 130 and the heat dissipation space S to increase heat dissipation efficiency. Preferably, each projecting rib 130*d* can be jammed between adjacent fin plates 114. Therefore, the heat dissipation tube 130 aligns and is coupled to the case 110 in the assembling process so as to raise assembling stability.

In the present invention, through thermal coupling between the heat dissipation tube 130 and the extending portion 122 of the fixing base 120, the heat produced from illumination of the lighting module 150 can be conducted to the heat dissipation tube 130 through the fixing base 120, and thereafter the heat inside the heat dissipation space S can be dissipated rapidly by means of heat convection so as to maintain fine opto-electronic conversion efficiency of the lighting module 150.

While this invention has been particularly illustrated and described in detail with respect to the preferred embodiments thereof, it will be clearly understood by those skilled in the art that it is not limited to the specific features and describes and various modifications and changes in form and details may be made without departing from the spirit and scope of this invention.

What is claimed is:

1. A lamp structure at least including:

a case having a shell and an accommodating chamber surrounded by the shell;

a fixing base disposed at the case and having a carrier and an extending portion, wherein the carrier comprises an upper surface and a lower surface and the extending portion extends and protrudes from the lower surface and wherein the extending portion comprises a first coupling surface;

a heat dissipation tube coupled to the fixing base and extending inside the accommodating chamber of the case, wherein a heat dissipation space is defined between the heat dissipation tube and the shell, wherein the heat dissipation tube comprises a second coupling surface in connection with the first coupling surface of the extending portion;

a lighting module disposed on the carrier; and an insulating sleeve coupled to the fixing base, wherein a conductive wire electrically connected with the lighting module is disposed within the insulating sleeve.

2. The lamp structure in accordance with claim 1, wherein the heat dissipation tube further comprises a first end and a second end, and the outer diameter of the heat dissipation tube gradually decreases from the first end toward the second end.

3. The lamp structure in accordance with claim 2, wherein the cross section area of the heat dissipation space gradually decreases from the first end toward the second end.

4. The lamp structure in accordance with claim 2, wherein the second end of the heat dissipation tube is in contact with the shell.

5. The lamp structure in accordance with claim 1, wherein the carrier further comprises an opening, such that the extending portion is located at the accommodating chamber and extends from the opening.

6. The lamp structure in accordance with claim 5, wherein the carrier and the extending portion are formed as one piece.

7. The lamp structure in accordance with claim 1, wherein the heat dissipation tube further comprises a connection body and a heat dissipation body having a top end portion connected with the connection body and a bottom end portion, and the outer diameter of the heat dissipation body gradually decreases from the top end portion toward the bottom end portion.

8. The lamp structure in accordance with claim 1, wherein the heat dissipation tube comprises a first surface, a second surface, a plurality of slots and a plurality of projecting ribs, the slots are in communication with the first surface and the second surface, wherein each projecting rib and each slot are arranged alternately.

9. The lamp structure in accordance with claim 8, wherein the fixing base further comprises a constraining portion disposed at the extending portion, and the heat dissipation tube is constrained between the carrier and the constraining portion.

10. A lamp structure comprising:

a case having a shell and an accommodating chamber surrounded by the shell;

a fixing base disposed at the case and having:

a carrier comprising an upper surface, a lower surface, and an opening and an extending portion located at the accommodating chamber and extending from the opening and protruding to the lower surface and comprising a first coupling surface;

a heat dissipation tube coupled to the fixing base and extending inside the accommodating chamber of the case and comprising a second coupling surface in connection with the first coupling surface of the extending portion, wherein a heat dissipation space is defined between the heat dissipation tube and the shell;

a lighting module disposed on the carrier; and an insulating sleeve coupled to the fixing base, wherein a conductive wire electrically connected with the lighting module is disposed within the insulating sleeve.

11. The lamp structure in accordance with claim 10, wherein the heat dissipation tube further comprises a first end and a second end, and the outer diameter of the heat dissipation tube gradually decreases from the first end toward the second end.

12. The lamp structure in accordance with claim 11, wherein the cross section area of the heat dissipation space gradually decreases from the first end toward the second end.

13. The lamp structure in accordance with claim 11, wherein the second end of the heat dissipation tube is in contact with the shell.

14. The lamp structure in accordance with claim 10, wherein the heat dissipation tube further comprises a connection body and a heat dissipation body having a top end portion connected with the connection body and a bottom end portion, and the outer diameter of the heat dissipation body gradually decreases from the top end portion toward the bottom end portion.

15. A lamp structure comprising:

a case having a shell and an accommodating chamber surrounded by the shell;

a fixing base disposed at the case and having a carrier;

a heat dissipation tube coupled to the fixing base and extending inside the accommodating chamber of the case, wherein a heat dissipation space is defined between the heat dissipation tube and the shell, the heat dissipation tube comprising a connection body and a heat dissipation body having a top end portion connected with the connection body and a bottom end portion, and wherein an outer diameter of the heat dissipation body gradually decreases from the top end portion toward the bottom end portion;

a lighting module disposed on the carrier; and an insulating sleeve coupled to the fixing base, wherein a conductive wire electrically connected with the lighting module is disposed within the insulating sleeve.

16. The lamp structure in accordance with claim 15, wherein the heat dissipation tube further comprises a first end and a second end, and the outer diameter of the heat dissipation tube gradually decreases from the first end toward the second end.

17. The lamp structure in accordance with claim 16, wherein the cross section area of the heat dissipation space gradually decreases from the first end toward the second end.

18. The lamp structure in accordance with claim 16, wherein the second end of the heat dissipation tube is in contact with the shell.

19. The lamp structure in accordance with claim 15, wherein the fixing base further comprises an extending portion, the carrier comprises an upper surface, a lower surface and an opening, the extending portion located at the accommodating chamber extends from the opening and protrudes to the lower surface, the extending portion comprises a first coupling surface, and the heat dissipation tube comprises a second coupling surface in connection with the first coupling surface of the extending portion.

* * * * *